US011098882B2

(12) United States Patent
Zhang

(10) Patent No.: US 11,098,882 B2
(45) Date of Patent: Aug. 24, 2021

(54) LAMP EASY TO REPLACE AND LAMP STRING STRUCTURE

(71) Applicant: C.E.T. Company Limited, Jiaxing (CN)

(72) Inventor: Hui Zhang, Jiaxing (CN)

( * ) Notice: Subject to any disclaimer, the term of this patent is extended or adjusted under 35 U.S.C. 154(b) by 171 days.

(21) Appl. No.: 16/409,872

(22) Filed: May 13, 2019

(65) Prior Publication Data

US 2020/0032986 A1 Jan. 30, 2020

(51) Int. Cl.

| | |
|---|---|
| ***F21V 21/008*** | (2006.01) |
| ***F21V 17/06*** | (2006.01) |
| ***F21V 23/00*** | (2015.01) |
| ***F21V 23/06*** | (2006.01) |
| *F21Y 115/10* | (2016.01) |

(52) U.S. Cl.

CPC ..... *F21V 21/008* (2013.01); *F21V 17/06* (2013.01); *F21V 23/001* (2013.01); *F21V 23/06* (2013.01); *F21Y 2115/10* (2016.08)

(58) Field of Classification Search

CPC ..... F21V 21/008; F21V 23/06
USPC ..... 362/249.14
See application file for complete search history.

(56) References Cited

U.S. PATENT DOCUMENTS

2010/0328953 A1* 12/2010 Wu ..... H01R 33/955 362/249.14
2011/0116254 A1* 5/2011 Workman ..... F21S 2/00 362/96
2016/0227629 A1* 8/2016 Conner ..... H05B 37/0254
2018/0128466 A1* 5/2018 Sonneman ..... F21S 2/005
2019/0282016 A1* 9/2019 Long ..... F21S 4/10

FOREIGN PATENT DOCUMENTS

CN 107509283 A 12/2007

* cited by examiner

*Primary Examiner* — Christopher M Raabe
(74) *Attorney, Agent, or Firm* — Bayramoglu Law Offices LLC

(57) ABSTRACT

This invention is easy to change lamp and a light string structure and it is easy to change lamp comprises lampshade lamp tube and lamp holder lamp holder. A light bunch structure comprises power supply line and a plurality of the lamp has a plurality of lead are connected on the power line power source line of the two ends are respectively fixedly connected with the inserting a front and tail socket a sleeve is set with a front insert tail insert a screw cap is set on the upper cover and tail socket a matched with the tail cap.

8 Claims, 3 Drawing Sheets

LAMP EASY TO REPLACE AND LAMP STRING STRUCTURE

CROSS-REFERENCE TO RELATED APPLICATIONS

This application claims priority to Chinese Patent Application No. 201821175514.0 with a filing date of Jul. 24, 2018. The content of the aforementioned applications, including any intervening amendments thereto, are incorporated herein by reference.

TECHNICAL FIELD

The present invention relates to the technical field of lighting equipment and particularly relates to a lamp easy to replace and a lamp string structure.

BACKGROUND ART

When a lamp cannot normally emit light due to failure, improper use or end of service life, the lamp often needs to be replaced. When an existing lamp cannot emit light, the whole lamp comprising a lamp shade and a lamp holder needs to be replaced, but when a lamp tube is damaged, the lamp shade and the lamp holder still can be normally used. Especially, when lamps such as a large number of decorative colored lamps need to be hung indoors or outdoors or when illuminating lamps need to be hung on outdoor buildings at night, once lamps cannot emit light, the whole lamps need to be replaced, and furthermore, lamp shades and lamp holders are discarded, thereby causing waste and also easily causing environmental damage.

SUMMARY OF THE INVENTION

In order to solve the above technical problems, the present invention provides a lamp easy to replace and a lamp string structure. When the lamp cannot emit light, only the lamp tube needs to be replaced, so that the environment is protected and the waste is avoided.

The technical scheme of the present invention for solving the above technical problems is as follows: the lamp easy to replace comprises a lamp shade, a lamp tube and a lamp holder, wherein the bottom end of the lamp holder covers the top end of the lamp shade, the center of the bottom end of the lamp holder is downward extended with a conductive socket, the lamp tube is arranged in the lamp shade, and the top end of the lamp tube is detachably connected with the conductive socket.

The present invention has the following beneficial effects: after the lamp tube is damaged and cannot emit light, the lamp can be reused only by replacing the lamp tube, and the lamp shade and the lamp holder can be repeatedly used, so that the environment is protected, the resource is saved, and the waste is avoided.

Based on the above technical scheme, the present invention can also be improved as follows.

Further, the bottom surface of the lamp holder is downward extended with a barrel, the barrel is positioned at the outer side of the conductive socket, the upper part of the lamp shade is provided with external threads, and the inner wall of the lower part of the barrel is provided with internal threads matched with the external threads.

By adopting the above further scheme, the present invention has the beneficial effect that the lamp is convenient and reliable in connection.

Further, an annular groove is formed in the inner wall of the middle part of the barrel, sealing gaskets are arranged in the annular groove, and the top surface of the lamp shade is abutted to the bottom surfaces of the sealing gaskets.

By adopting the above further scheme, the present invention has the beneficial effect that the sealing gaskets are tightly pressed on the top wall of the annular groove by the top surface of the lamp shade to form sealing, so that the lamp has good water resistance.

Further, a hook is fixed at the top end of the lamp holder.

By adopting the above further scheme, the present invention has the beneficial effect that the lamp can be directly hung through the hook to adapt to indoor or outdoor lamp arrangement, so that the lamp is convenient to use.

Further, a wire is fixed in the lamp holder in a penetrated mode, one end of the wire extends out of the lamp holder, and the other end of the wire is electrically connected with the conductive socket.

By adopting the above further scheme, the present invention has the beneficial effects that the lamp is simple in structure and easy in production.

Further, a wire is arranged in the lamp holder in a penetrated mode, the left and right ends of the wire extend out of the left and right ends of the lamp holder respectively, and the conductive socket is electrically connected with the wire.

By adopting the above further scheme, the present invention has the beneficial effects that the lamp is convenient in connection and is suitable for being placed and hung indoors or outdoors.

Further, the lamp tube comprises a protective cover, a conductive plug and an LED filament arranged in the protective cover, wherein the top of the protective cover is fixed at the bottom of the conductive plug, the top of the conductive plug is fixedly connected with the bottom of the conductive socket, and the LED filament is electrically connected with the conductive socket through the conductive plug.

By adopting the above further scheme, the present invention has the beneficial effects that the lamp is simple in structure; the lamp tube is protected through the protective cover, so that the damaged lamp tube can be conveniently replaced, and a new lamp tube can be conveniently installed; and the lamp is safe and reliable.

Further, a jack is formed in the bottom surface of the conductive socket, a core insert is fixed at the center of the jack, the core insert is electrically connected with the middle part of the wire, the inner wall of the jack is connected with an elastic sheet, a plug hole matched with the core insert is formed in the center of the conductive plug, the conductive plug extends into the jack, and the outer wall of the conductive plug is abutted to the elastic sheet.

By adopting the above further scheme, the present invention has the beneficial effect that the lamp tube and the conductive socket are tightly matched and installed through the elastic sheet to prevent the lamp tube from loosening and falling, so that the lamp is safer.

Another technical scheme of the present invention for solving the above technical problems is as follows:

A lamp string structure comprises a power line and a plurality of lamps, wherein a plurality of wires are connected to the power line, two ends of the power line are fixedly connected with a positive plug A and a tail plug A respectively, the positive plug A is sleeved with a screw cap, and the tail plug A is sleeved with a tail cap matched with the tail plug A.

The present invention has the beneficial effects that the lamp is suitable for indoor or outdoor lamp arrangement and is simple and convenient in connecting structure; and the positive plug A and the tail plug A are protected by the screw cap and the tail cap, thereby preventing electric shock, and the like.

Further, the lamp string structure also comprises a controller connecting line and a controller for controlling the light emitting state of the lamp, wherein two ends of the controller connecting line are fixedly connected with a positive plug B and a tail plug B for switching on a power supply respectively, the controller is connected to the middle part of the controller connecting line, and the tail plug B is connected with the positive plug A in an inserted mode.

By adopting the above further scheme, the present invention has the beneficial effect that the light emitting state of the lamp is controlled by the controller, so that the lamp is more intelligent.

Figure 1:
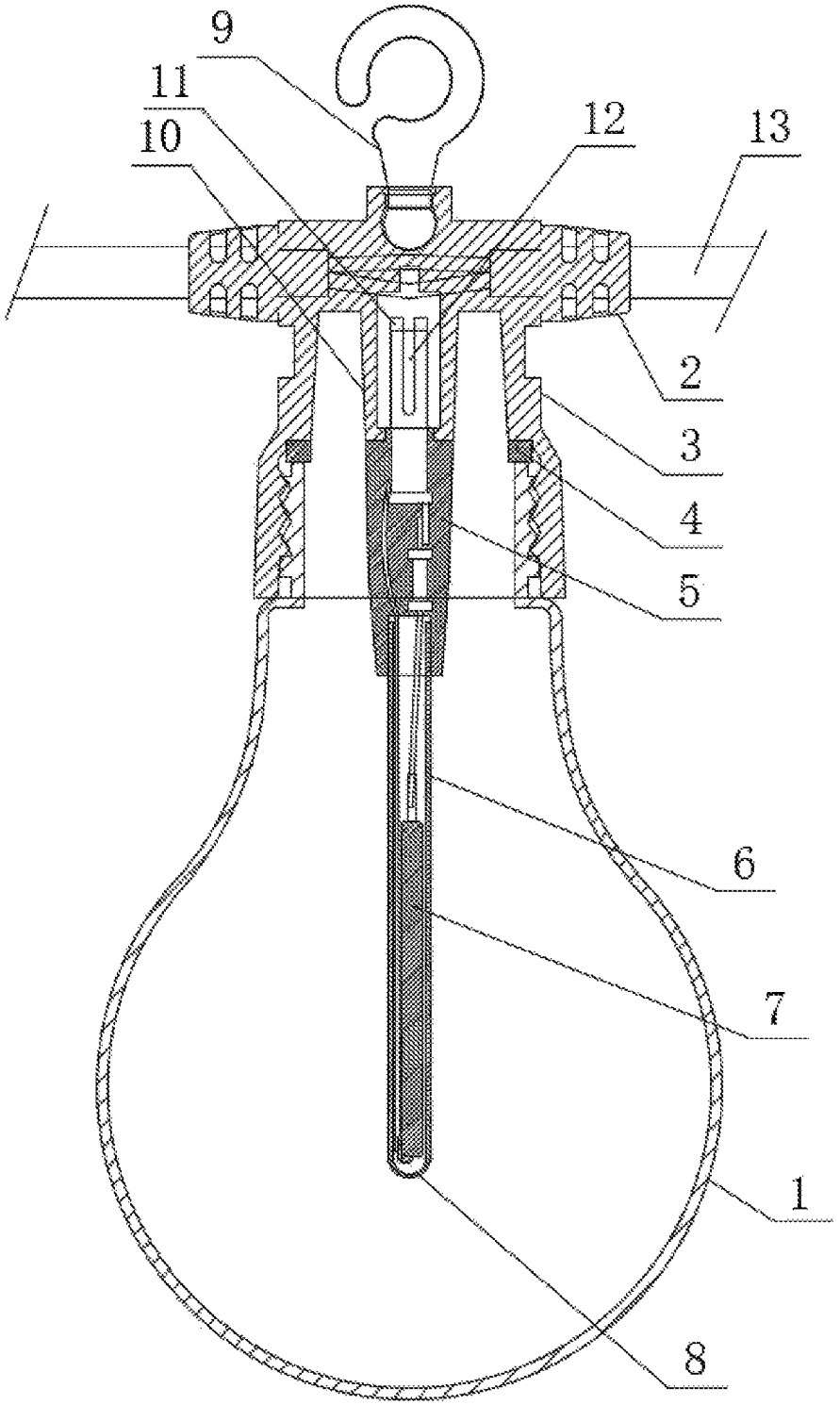
FIG. 1 is a structural schematic diagram of a lamp easy to replace provided by the present invention.

In the drawings, the components represented by respective numerals are as follows:

1 Lamp shade, 2 Lamp holder, 3 Barrel, 4 Sealing gasket, 5 Conductive plug, 6 Lamp tube, 7 LED filament, 8 Protective cover, 9 Hook, 10 Conductive socket, 11 Jack, 12 Core insert, 13 Wire, 14 Positive plug B, 15 Controller connecting line, 16 Controller, 17 Tail plug B, 18 Positive plug A, 19 Screw cap, 20 Power line, 21 Tail plug A, 22 Tail cap, 23 Connecting rope.

DETAILED DESCRIPTION OF THE INVENTION

The principles and features of the present invention are described below in conjunction with the accompanying drawings. The embodiments are only used for explaining the present invention but not used for limiting the scope of the present invention.

FIG. 1 is a structural schematic diagram of a lamp easy to replace provided by the present invention. The lamp comprises a lamp shade 1, a lamp tube 6 and a lamp holder 2, wherein the bottom end of the lamp holder 2 covers the top end of the lamp shade 1, the center of the bottom end of the lamp holder 2 is downward extended with a conductive socket 10, the lamp tube 6 is arranged in the lamp shade 1, and the top end of the lamp tube 6 is detachably connected with the conductive socket 10. After the lamp tube 6 is damaged and cannot emit light, the lamp can be reused only by replacing the lamp tube 6, and the lamp shade 1 and the lamp holder 2 can be repeatedly used, so that the environment is protected, the resource is saved, and the waste is avoided.

Specifically, the lamp shade 1 is a hollow container with arbitrary shape, and the top end of the lamp shade 1 is opened, so that the lamp has different shapes and is beautiful.

A wire 13 is fixed in the lamp holder 2, the left and right ends of the wire 13 extend out of the left and right ends of the lamp holder 2 respectively, and the conductive socket 10 is electrically connected with the wire 13. Specifically, the lamp tube 6 is connected with the power supply through the conductive socket 10 and the wire 13 so as to be conducted to emit light.

The lamp tube 6 comprises a protective cover 8, a conductive plug 5 and an LED filament 7 arranged in the protective cover 8, wherein the top of the protective cover 8 is fixed at the bottom of the conductive plug 5, the top of the conductive plug 5 is fixedly connected with the bottom of the conductive socket 10, and the LED filament 7 is electrically connected with the conductive socket 10 through the conductive plug 5.

Specifically, the lamp tube 6 is an LED lamp tube 6 which is energy-saving and environmentally friendly. The conductive plug 5 is welded with a wire and is electrically connected with the LED filament 7 through the wire, the lower part of the conductive plug is fixedly sleeved with a plastic layer by PVC plastic injection molding, and the protective cover is assembled on the plastic layer so as to be fixed and sealed to form the lamp tube 6.

A jack 11 is formed in the bottom surface of the conductive socket 10, a core insert 12 is fixed at the center of the jack 11, the core insert 12 is electrically connected with the middle part of the wire 13, the inner wall of the jack 11 is connected with an elastic sheet, a plug hole matched with the core insert 12 is formed in the center of the conductive plug 5, the conductive plug 5 extends into the jack 11, and the outer wall of the conductive plug 5 is abutted to the elastic sheet.

Specifically, when the conductive plug 5 extends into the jack 11, the outer wall of the conductive plug 5 is in contact with the elastic sheet and outward extrudes the elastic sheet. After the conductive plug 5 is connected with the jack 11 in an inserted mode, under the action of resilience of the elastic sheet, the conductive plug 5 is clamped in the conductive socket 10 to ensure reliable and stable insertion.

The bottom surface of the lamp holder 2 is downward extended with a barrel 3, the barrel 3 is positioned at the outer side of the conductive socket 10, the upper part of the lamp shade 1 is provided with external threads, and the inner wall of the lower part of the barrel 3 is provided with internal threads matched with the external threads. The lamp shade 1 and the lamp holder 2 are in threaded connection. When the lamp tube 6 needs to be replaced, the lamp holder 2 and the lamp shade 1 can be separated directly by screwing off the external threads and the internal threads; because the lamp tube 6, the protective cover 8 and the conductive plug 5 are integrated, the lamp tube 6 can be directly pulled out; and then, a new lamp tube is inserted into the conductive socket 10, and the lamp shade 1 and the lamp holder 2 are subjected to threaded connection again, so that the lamp tube can be simply and conveniently replaced.

An annular groove is formed in the inner wall of the middle part of the barrel 3, sealing gaskets 4 are arranged in the annular groove, and the top surface of the lamp shade 1 is abutted to the bottom surfaces of the sealing gaskets 4.

Specifically, the sealing gaskets 4 are made of silica gel. The sealing gaskets 4 are tightly pressed on the top wall of the annular groove by the top surface of the lamp shade 1 to form sealing, so that the lamp has good water resistance.

A hook 9 is fixed at the top end of the lamp holder 2. Specifically, a plurality of lamps can be connected together in series or in parallel through the wire 13, and further, one or more lamps can be hung in the air through the hook 9, thereby being suitable for indoor and outdoor arrangement of decorative lamp walls.

Figure 2:
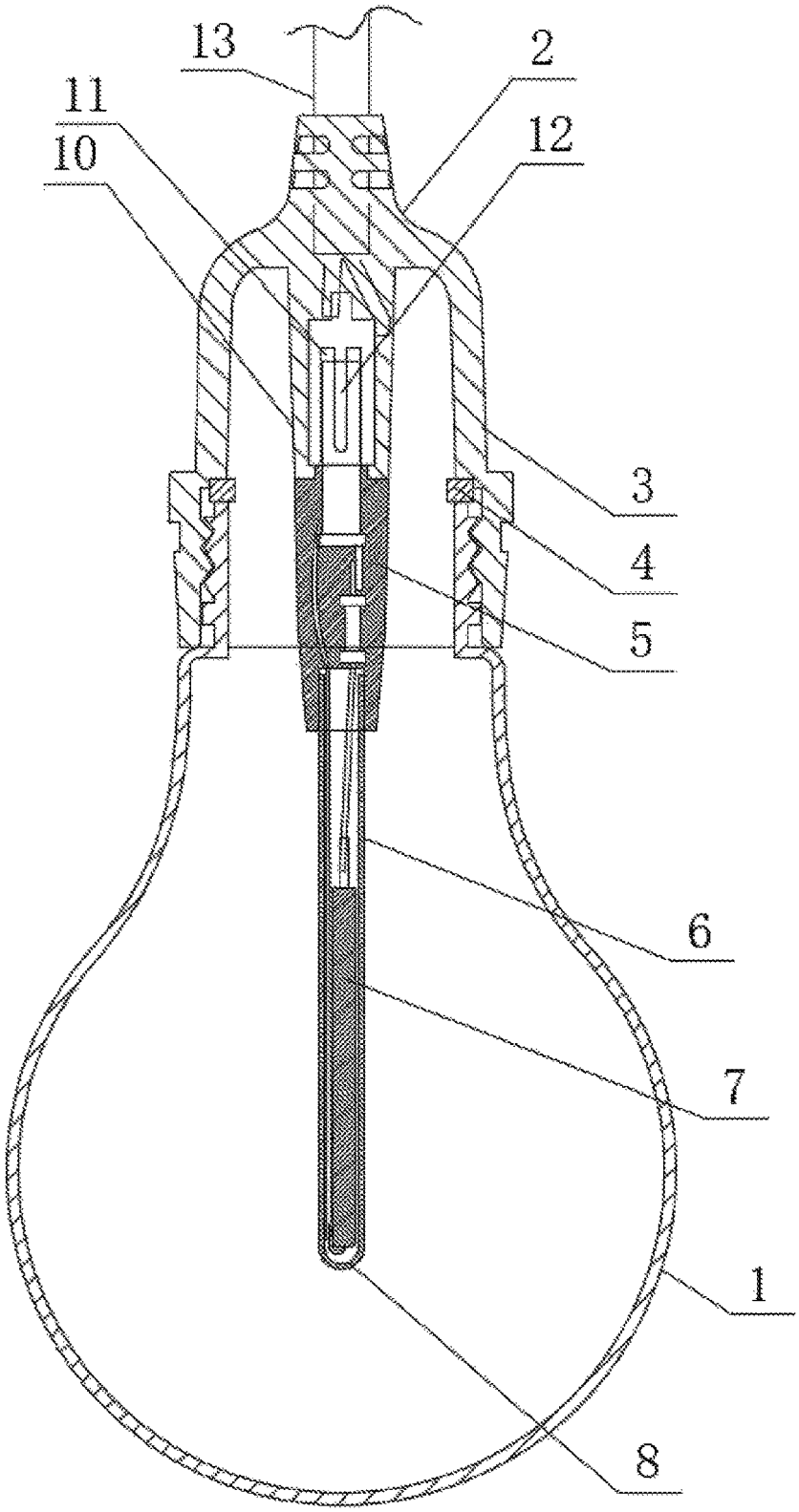
FIG. 2 is a structural schematic diagram of another lamp easy to replace provided by an embodiment of the present invention.

FIG. 2 is a structural schematic diagram of another lamp easy to replace provided by an embodiment of the present invention. The lamp comprises a lamp shade 1 and a lamp holder 2, wherein the bottom end of the lamp holder 2 covers the top end of the lamp shade 1, the center of the bottom end of the lamp holder 2 is downward extended with a conductive socket 10, the lamp tube 6 is arranged in the lamp shade 1, and the top end of the lamp tube 6 is detachably connected with the conductive socket 10. After the lamp tube 6 is damaged and cannot emit light, the 1 amp can be reused only by replacing the lamp tube 6, and the lamp shade 1 and the lamp holder 2 can be repeatedly used, so that the environment is protected, the resource is saved, and the waste is avoided.

Specifically, the lamp shade 1 is a hollow container with arbitrary shape, and the top end of the lamp shade 1 is opened, so that the lamp has different shapes and is beautiful.

A wire 13 is fixed in the lamp holder 2 in a penetrated mode, one end of the wire 13 extends out of the lamp holder 2, and the other end of the wire 13 is electrically connected with the conductive socket 10.

Specifically, the lamp tube 6 is connected with the power supply through the conductive socket 10 and the wire 13 so as to be conducted to emit light. The top end of the wire 13 extends out of the lamp holder 2, and the bottom end of the wire 13 is electrically connected with the conductive socket 10. The lamp is suitable for household suspended ceilings and is arranged on a ceiling or a lamp bracket.

The lamp tube 6 comprises a protective cover 8, a conductive plug 5 and an LED filament 7 arranged in the protective cover 8, wherein the top of the protective cover 8 is fixed at the bottom of the conductive plug 5, and the LED filament 7 is electrically connected with the conductive socket 10 through the conductive plug 5.

Specifically, the lamp tube 6 is an LED lamp tube which is energy-saving and environmentally friendly. The conductive plug 5 is welded with a wire and is electrically connected with the LED filament 7 through the wire, the lower part of the conductive plug is fixedly sleeved with a plastic layer by PVC plastic injection molding, and the protective cover is assembled on the plastic layer so as to be fixed and sealed to form the lamp tube 6.

A jack 11 is formed in the bottom surface of the conductive socket 10, a core insert 12 is fixed at the center of the jack 11, the core insert 12 is electrically connected with the wire 13, the inner wall of the jack 11 is connected with an elastic sheet, a plug hole matched with the core insert 12 is formed in the center of the conductive plug 5, the conductive plug 5 extends into the jack 11, and the outer wall of the conductive plug 5 is abutted to the elastic sheet.

Specifically, when the conductive plug 5 extends into the jack 11, the outer wall of the conductive plug 5 is in contact with the elastic sheet and outward extrudes the elastic sheet. After the conductive plug 5 is connected with the jack 11 in an inserted mode, under the action of resilience of the elastic sheet, the conductive plug 5 is clamped in the conductive socket 10 to ensure reliable and stable insertion.

The bottom surface of the lamp holder 2 is downward extended with a barrel 3, the barrel 3 is positioned at the outer side of the conductive socket 10, the upper part of the lamp shade 1 is provided with external threads, and the inner wall of the lower part of the barrel 3 is provided with internal threads matched with the external threads. The lamp shade 1 and the lamp holder 2 are in threaded connection. When the lamp tube 6 needs to be replaced, the lamp holder 2 and the lamp shade 1 can be separated directly by screwing off the external threads and the internal threads; because the lamp tube 6, the protective cover 8 and the conductive plug 5 are integrated, the lamp tube 6 can be directly pulled out; and then, a new lamp tube is inserted into the conductive socket 10, and the lamp shade 1 and the lamp holder 2 are subjected to threaded connection again, so that the lamp tube can be simply and conveniently replaced.

An annular groove is formed in the inner wall of the middle part of the barrel 3, sealing gaskets 4 are arranged in the annular groove, and the top surface of the lamp shade 1 is abutted to the bottom surfaces of the sealing gaskets 4.

Specifically, the sealing gaskets 4 are made of silica gel. The sealing gaskets 4 are tightly pressed on the top wall of the annular groove by the top surface of the lamp shade 1 to form sealing, so that the lamp has good water resistance.

The lamp easy to replace provided by the embodiment of the present invention is described in detail above with reference to FIG. 1 and FIG. 2. A lamp string structure is described in detail below with reference to FIG. 1 and FIG. 3.

Figure 3:
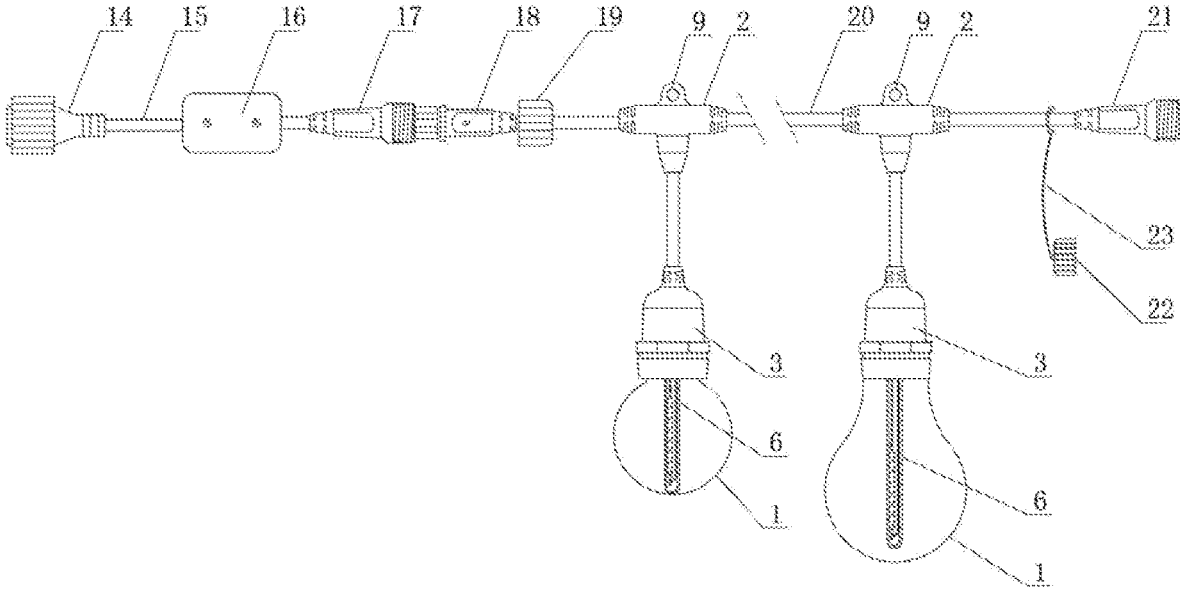
FIG. 3 is a schematic diagram of a lamp string structure of the present invention.

As shown in FIG. 3, a lamp string structure comprises a power line 20 and a plurality of lamps, wherein a plurality of wires 13 are connected to the power line 20, two ends of the power line 20 are fixedly connected with a positive plug A18 and a tail plug A21 respectively, the positive plug A18 is sleeved with a screw cap 19, and the tail plug A21 is sleeved with a tail cap 22 matched with the tail plug A21.

Specifically, a plurality of wires 13 are connected to the power line 20 in series or in parallel. The tail cap 22 is hung on the power line 20 through a connecting rope 23 so as to prevent the tail cap 22 from being lost when the tail cap 22 is separated from the tail plug A21. The power line 20 and the wires 13 are integrally formed.

The lamp string structure also comprises a controller connecting line 15 and a controller 16 for controlling the light emitting state of the lamp, wherein two ends of the controller connecting line 15 are fixedly connected with a positive plug B14 and a tail plug B17 for switching on a power supply respectively, the controller 16 is connected to the middle part of the controller connecting, line 15, and the tail plug B17 is connected with the positive plug A18 in an inserted mode.

Specifically, the positive plug A18 and the positive plug B14 have the same structure, the tail plug A21 and the tail plug B17 have the same structure, and the peripheral side walls of the tail plug A21 and the tail plug B17 are provided with threads matched with the screw cap 19, thereby ensuring more stable insertion of the positive plug A18 or the positive plug B14 and the tail plug A21. Therefore, the positive plug A18 and the tail plug A21 at two ends of the lamp string structure are arranged in a matched mode, and a plurality of lamp string structures can be connected in series or in parallel, thereby being suitable for arrangement of decorative lamps and convenient in use. In addition, the controller 16 can control the lamp tube to realize various functions, such as flickering, constant lighting, timing, memory, light control, remote control (infrared, wireless WIFI), and the like. The controller 16 is included in the prior art, the model of the controller 16 is CET-Y240D-A, and the control principle of the controller 16 refers to an LED lamp control system with common positive and negative electrodes (application number: CN201710918921.X).

The above embodiments are preferred embodiments of the present invention and are not intended to limit the present invention. Any modifications, equivalent replacements, improvements, and the like made according to the spirit and principle of the present invention are intended to be included within the protection scope of the present invention.

I claim:

1. A lamp easy to replace comprising a lamp shade, a lamp holder and a lamp tube, wherein the bottom end of the lamp holder covers the top end of the lamp shade, the center of the bottom end of the lamp holder is downward extended with a conductive socket, the lamp tube is arranged in the lamp shade, and the top end of the lamp tube is detachably connected with the conductive socket;

wherein the bottom surface of the lamp holder is downward extended with a barrel, the barrel is positioned at the outer side of the conductive socket, the upper part of the lamp shade is provided with external threads, and the inner wall of the lower part of the barrel is provided with internal threads matched with the external threads and an annular groove is formed in the inner wall of the middle part of the barrel, sealing gaskets are arranged in the annular groove, and the top surface of the lamp shade is abutted to the bottom surfaces of the sealing gaskets.

2. The lamp easy to replace according to claim 1, wherein a wire is fixed in the lamp holder in a penetrated mode, one end of the wire extends out of the lamp holder, and the other end of the wire is electrically connected with the conductive socket.

3. The lamp easy to replace according to claim 1, wherein a wire is arranged in the lamp holder in a penetrated mode, the left and right ends of the wire extend out of the left and right ends of the lamp holder respectively, and the conductive socket is electrically connected with the wire.

4. The lamp easy to replace according to claim 3, wherein a hook is fixed at the top end of the lamp holder.

5. The lamp easy to replace according to claim 2, wherein the lamp tube comprises a protective cover, a conductive plug and an LED filament arranged in the protective cover, wherein the top of the protective cover is fixed at the bottom of the conductive plug, the top of the conductive plug is fixedly connected with the bottom of the conductive socket, and the LED filament is electrically connected with the conductive socket through the conductive plug.

6. The lamp easy to replace according to claim 5, wherein a jack is formed in the bottom surface of the conductive socket, a core insert is fixed at the center of the jack, the core insert is electrically connected with the wire, the inner wall of the jack is connected with an elastic sheet, a plug hole matched with the core insert is formed in the center of the conductive plug, the conductive plug extends into the jack, and the outer wall of the conductive plug is abutted to the elastic sheet.

7. A lamp string structure comprising a power line and a plurality of lamps according to claim 3, wherein a plurality of wires are connected to the power line, two ends of the power line are fixedly connected with a positive plug A and a tail plug A respectively, the positive plug A is sleeved with a screw cap, and the tail plug A is sleeved with a tail cap matched with the tail plug A.

8. The lamp string structure according to claim 7, further comprising a controller connecting line and a controller for controlling the light emitting state of the lamp, wherein two ends of the controller connecting line are fixedly connected with a positive plug B and a tail plug B for switching on a power supply respectively, the controller is connected to the middle part of the controller connecting line, and the tail plug B is connected with the positive plug A in an inserted mode.

* * * * *